US012366390B2

(12) United States Patent
Pereira et al.

(10) Patent No.: US 12,366,390 B2
(45) Date of Patent: Jul. 22, 2025

(54) DOUBLE SKIN HEAT EXCHANGER APPARATUS AND SYSTEM

(71) Applicant: THE COCA-COLA COMPANY, Atlanta, GA (US)

(72) Inventors: Roberto Horn Pereira, Suwanne, GA (US); Luciana Wasnievski Da Silva De Luca Ramos, Marietta, GA (US); Norman Badaoui, Atlanta, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 221 days.

(21) Appl. No.: 17/926,064

(22) PCT Filed: May 28, 2021

(86) PCT No.: PCT/US2021/034762
§ 371 (c)(1),
(2) Date: Nov. 17, 2022

(87) PCT Pub. No.: WO2021/243155
PCT Pub. Date: Dec. 2, 2021

(65) Prior Publication Data

US 2023/0194134 A1 Jun. 22, 2023

Related U.S. Application Data

(60) Provisional application No. 63/032,239, filed on May 29, 2020.

(51) Int. Cl.
*F25B 39/02* (2006.01)
*F25B 13/00* (2006.01)
(Continued)

(52) U.S. Cl.
CPC ..... *F25B 39/024* (2013.01); *F25B 13/00* (2013.01); *F25D 21/12* (2013.01); *F28F 3/12* (2013.01)

(58) Field of Classification Search
CPC ..... F25B 39/024; F25B 17/00; F25D 21/12; F28F 3/12; F28D 9/00; F28D 9/0025
See application file for complete search history.

(56) References Cited

U.S. PATENT DOCUMENTS 2,511,851 A * 6/1950 Iwashita ..... F25D 11/025 62/51.1
2,687,626 A * 8/1954 Bartlowe ..... F25D 21/08 29/890.035
(Continued)

FOREIGN PATENT DOCUMENTS

CN 206847150 U 1/2018
CN 209484876 U 10/2019
(Continued)

OTHER PUBLICATIONS

KR-20060019433-A Translation (Year: 2006).*
(Continued)

*Primary Examiner* — David J Teitelbaum
(74) *Attorney, Agent, or Firm* — Meunier Carlin & Curfman LLC

(57) ABSTRACT

A heat exchanger module includes a skin condenser and a skin evaporator. The skin condenser includes an inner condenser plate, an outer condenser plate coupled to the inner condenser plate and a condenser tube channel formed on one of the inner condenser plate and/or the outer condenser plate. The evaporator includes an inner evaporator plate, an outer evaporator plate coupled to the inner evaporator plate, and an evaporator tube channel formed on one of the inner evaporator plate and/or the outer evaporator plate. The heat exchanger also includes an insulation layer extending between the inner condenser plate and the inner evaporator plate. Each of the plates that form the skin condenser and/or evaporator can be formed from different materials and/or have different material thicknesses to reduce heat transfer
(Continued)

through the insulation layer from the condenser to the evaporator while also promoting heat transfer through natural convection with surrounding air.

19 Claims, 11 Drawing Sheets

(51) Int. Cl.
*F25D 21/12* (2006.01)
*F28F 3/12* (2006.01)

(56) References Cited

U.S. PATENT DOCUMENTS

| | | | | |
|---|---|---|---|---|
| 8,931,300 | B2 | 1/2015 | Smith et al. | |
| 2006/0250061 | A1* | 11/2006 | Cheon | F25D 23/066 312/401 |
| 2011/0197623 | A1* | 8/2011 | Ascani | F25D 23/061 62/441 |
| 2019/0368754 | A1* | 12/2019 | Blanton | G05D 23/1919 |

FOREIGN PATENT DOCUMENTS

| | | | | |
|---|---|---|---|---|
| EP | 0819899 | A2 | 1/1998 | |
| FR | 2542074 | A1 * | 9/1984 | |
| GB | 1259025 | A | 1/1972 | |
| JP | 03-037118 | B2 | 6/1991 | |
| KR | 20060019433 | A * | 3/2006 | |
| KR | 10-2013-0011276 | A | 1/2013 | |
| KR | 10-2014-0039374 | A | 4/2014 | |
| WO | WO-2012031894 | A2 * | 3/2012 | F25B 5/02 |

OTHER PUBLICATIONS

FR-2542074-A1 Translation (Year: 1984).*
WO-2012031894-A2 Translation (Year: 2012).*
International Search Report and Written Opinion issued in International Application No. PCT/US2021/034762, mailed Sep. 17, 2021, 11 Pages.
Extended European Search Report issued in EP21813187.8 mailed Jun. 14, 2024.

* cited by examiner

DOUBLE SKIN HEAT EXCHANGER APPARATUS AND SYSTEM

CROSS-REFERENCE TO RELATED APPLICATIONS

This application is a national phase entry under 35 U.S.C. § 371 of International Application No. PCT/US2021/034762, filed on May 28, 2021, which claims the benefit of U.S. Provisional Application Ser. No. 63/032,239 filed May 29, 2020.

BACKGROUND OF THE DISCLOSURE

Skin heat exchangers for refrigeration systems utilize independent components which are manufactured separately and assembled later in production. A double skin heat exchanger may be fabricated by affixing refrigeration tubes to a refrigeration compartment's walls with a tape. Refrigeration tubes can be affixed to an external side or internal side of a refrigeration compartment's surface. Sometimes, insulation can be injected and expanded between prefabricated plates to insulate and secure the tubes. This type of system is typically used for domestic and commercial refrigeration. Another type of skin heat exchanger may be formed using roll-bonding techniques for separate heat exchanger components. Roll-bond type evaporator plates may be used because, traditional refrigeration tubes are difficult to bend, and do not allow a user to explore smaller spaced configurations or layout variances. Each of these configurations use fans to circulate air to improve heat transfer with the evaporator and/or condenser of a refrigeration system.

SUMMARY

Various implementations include a heat exchanger module. In some implementations, the heat exchanger module includes a skin condenser. The skin condenser includes an inner condenser plate, an outer condenser plate coupled to the inner condenser plate, and a condenser tube channel. The condenser tube channel is formed on one of the inner condenser plate or the outer condenser plate. The heat exchanger module also includes a skin evaporator. The skin evaporator includes an inner evaporator plate, an outer evaporator plate coupled to the inner evaporator plate, and an evaporator tube channel formed on one of the inner evaporator plate or the outer evaporator plate. The heat exchanger also includes an insulation layer extending between the inner condenser plate and the inner evaporator plate.

In some implementations, the skin evaporator forms at least a portion of a refrigeration enclosure. In some implementations, the skin evaporator is formed to remove heat from the refrigeration enclosure through natural convection.

In some implementations, an internal surface of the inner condenser plate and an internal surface of the outer condenser plate are at least partially coupled together, and an internal surface of the inner evaporator plate and an internal surface of the outer evaporator plate are at least partially coupled together.

In some implementations, the inner condenser plate and the outer condenser plate are coupled together by roll-bonding. In some implementations, the inner evaporator plate and the outer evaporator plate are coupled together by roll-bonding. Additionally, the inner condenser plate and the outer condenser plate can be coupled together using an adhesive, welding, brazing, or any other fastening mechanism capable of coupling the two plates. Additionally, the inner evaporator plate and the outer evaporator plate can be coupled together using an adhesive, welding, brazing, or any other fastening mechanism capable of coupling the two plates.

In some implementations, the evaporator tube channel has an inlet and an outlet and forms a canalization pattern. In some implementations, the canalization pattern includes a series of bends and elongated sections between the inlet and the outlet.

In some implementations, the canalization pattern is evenly distributed between the inlet and the outlet of the evaporator tube channel.

In some implementations, the canalization pattern is non-uniformly distributed between the inlet and the outlet of the evaporator tube channel.

In some implementations, the skin evaporator includes an upper section and a lower section. A greater portion of the evaporator tube channel is disposed in the lower section than the upper section.

In some implementations, the skin evaporator includes an inner section and an outer section. A greater portion of a surface area of the capillary is disposed in the outer section than the inner section.

In some implementations, the heat exchanger includes a suction line extending between the evaporator outlet and the compressor inlet.

In some implementations, the skin condenser, skin evaporator, and insulation layer are formed to conform to the shape of a refrigeration enclosure.

In some implementations, the inner condenser plate has a lower thermal conductivity than the outer condenser plate.

In some implementations, the inner evaporator plate has a lower thermal conductivity than the outer evaporator plate.

In some implementations, a thickness of the inner condenser plate is greater than a thickness of the outer condenser plate.

In some implementations, a thickness of the inner evaporator plate is greater than the thickness of the outer evaporator plate.

In some implementations, the inner condenser plate, outer condenser plate, inner evaporator plate, and outer evaporator plate, are formed from a material selected from the group consisting of polyurethane, polyethylene terephthalate, vacuum insulation paneling, and a combination of multiple polymers.

Various other implementations include a heat exchanger modular system. The system includes a heat exchanger module. In some implementations, the heat exchanger module includes a skin condenser. The skin condenser includes an inner condenser plate, an outer condenser plate coupled to the inner condenser plate, and a condenser tube channel. The condenser tube channel is formed on one of the inner condenser plate or the outer condenser plate. The module also includes a skin evaporator. The evaporator includes an inner evaporator plate, an outer evaporator plate coupled to the inner evaporator plate, and an evaporator tube channel formed on one of the inner evaporator plate or the outer evaporator plate. The heat exchanger also includes an insulation layer extending between the inner condenser plate and the inner evaporator plate. The system includes a compressor disposed between and in fluidic communication with the condenser and the evaporator. The system includes a refrigerated cabinet having an enclosure surface. The evaporator tube channel is in thermal communication with the refrigerated cabinet.

In some implementations, the refrigerated cabinet encloses a refrigeration volume, wherein air in the refrigeration volume exchanges heat with the skin evaporator by natural convection.

In some implementations, the system includes a defrost loop disposed between and in fluidic communication with the condenser tube channel and the evaporator tube channel.

In some implementations, the defrost loop includes a 2-way valve coupled to the condenser tube channel, a check valve coupled to the evaporator tube channel, and a circulation capillary coupled to and extending between the 2-way valve and the check valve. The system also includes a defrosting capillary coupled to and extending between the 2-way valve and the check valve. The defrost loop is configurable between a circulation configuration and a defrosting configuration. The 2-way valve channels fluid through the circulation capillary when in the circulation configuration. The 2-way valve also channels fluid thorough the defrosting capillary, when in the defrosting configuration. The check valve is formed to prevent fluid from the evaporator tube channel and the circulation capillary from entering the defrosting capillary.

In some implementations, the diameter of the defrosting capillary is greater than the diameter of the circulation capillary.

In some implementations the modular system includes a t-joint having two inlets. The inlets are coupled to the circulation capillary and the defrosting capillary. The check valve is disposed at the inlet coupled to the defrosting capillary.

In some implementations, the circulation capillary and the defrosting capillary are at least partially disposed between the inner evaporator plate and the outer evaporator plate.

In some implementations, the t-joint is at least partially disposed between the inner evaporator plate and the outer evaporator plate.

DETAILED DESCRIPTION OF THE DISCLOSURE

Figure 1A:
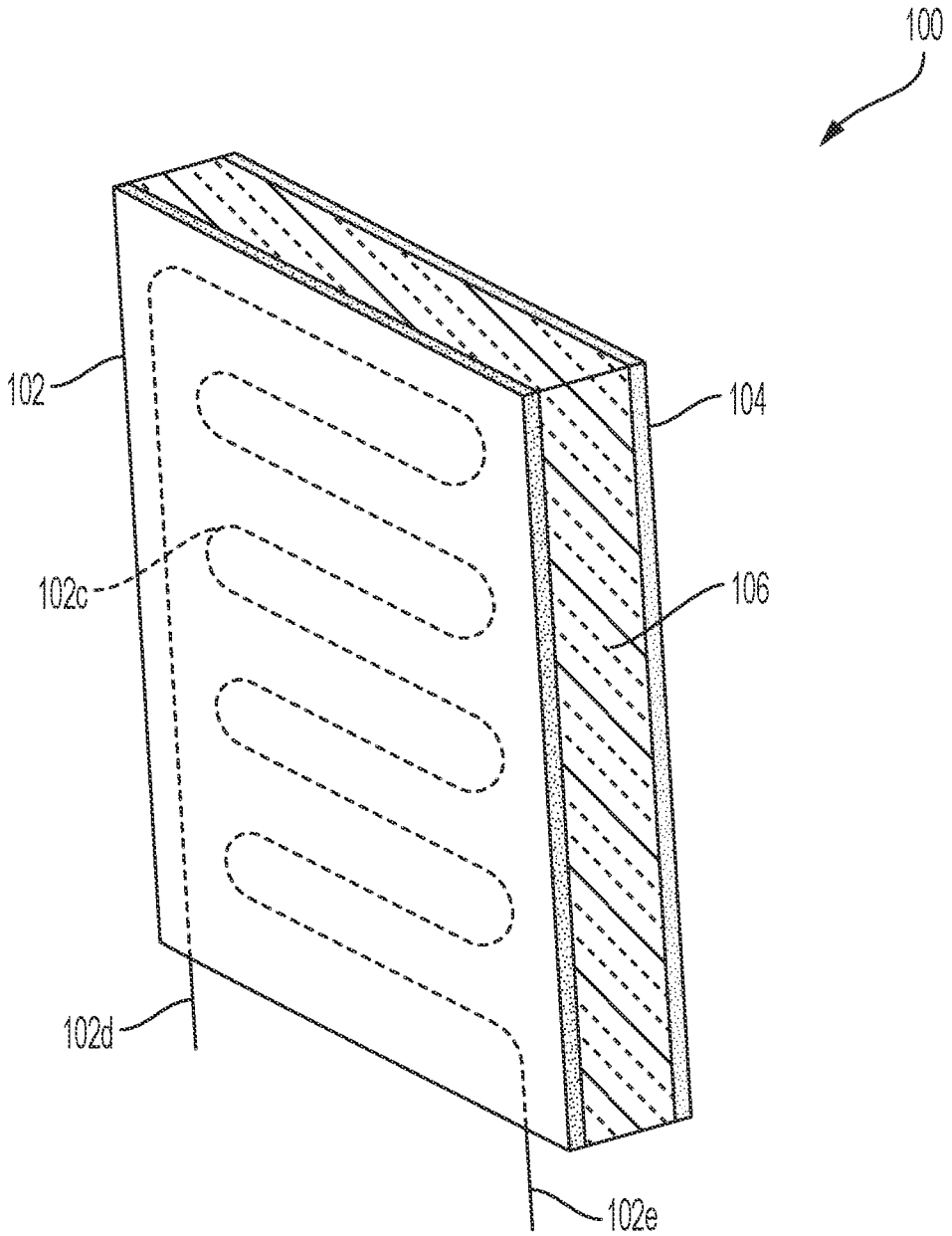
FIG. 1A shows a perspective view of a heat exchanger module.

In the following description, specific details are set forth describing some implementations consistent with the present disclosure. Numerous specific details are set forth in order to provide a thorough understanding of the implementations. It will be apparent, however, to one skilled in the art that some implementations may be practiced without some or all of these specific details. The specific implementations disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one implementation may be incorporated into other implementations unless specifically described otherwise or if the one or more features would make an implementation non-functional. In some instances, well known methods, procedures, and components have not been described in detail so as not to unnecessarily obscure aspects of the implementations.

In a traditional skin heat exchanger where the tubes are affixed with tape, installation of a refrigeration tube must be done carefully, to ensure that the tube is secured against plate components. If the sizing or application of the adhesive tape is not done correctly, the tube may detach from the plate after insulation foam has been injected and expanded between the tube and the plate. This increases the thermal resistance and is harmful to the performance of the system. Adhesive tape can also act as a barrier for the insulator. Both adhesive affixed and roll-bonded heat exchangers are component based and require separate modular construction and installation. Additionally, each of these systems typically require a fan to circulate air and facilitate refrigeration, which adds weight and takes up space in a refrigeration system. Refrigeration systems with fans also incur additional operating cost for the fan due to energy consumption. Additionally, fans can require repairs during the operating life of the refrigeration system incurring additional costs for an operator. There exists a need for a heat exchanger that can be manufactured as a self-contained unit needing no fans to circulate air for refrigeration.

Various implementations include a refrigeration system that utilizes double skin heat exchangers, including a skin condenser, and a skin evaporator. Some implementations include a compressor, an expansion device, and an internal defroster. In the refrigeration system, heat is transferred by natural convection from the skin condenser to a surrounding environment and from air in a refrigerated enclosure to the skin evaporator. Forming a heat exchanger module with the skin evaporator on one side of the module, the skin condenser on an opposite side of the module, and insulation therebetween allows a heat exchanger to be integrated into a refrigeration system as a uniformly manufactured system that includes the heat exchanger components in a uniform article. As such, no fans are necessary, thereby reducing system cost, noise, energy, and space consumption. In some implementations, where the refrigeration system is integrated into a light commercial refrigerator, refrigeration without the use of the fan is beneficial for efficiently refrigerating a moderately sized refrigeration cabinet.

In various implementations, the skin condenser and/or skin evaporator of the heat exchanger module is formed with materials of different thermal conductivities. For example, an air contacting surface of the skin condenser may be formed of a first material with a first thermal conductivity. An insulation contacting surface of the skin condenser may be formed of a second material with a second thermal conductivity lower than the first thermal conductivity. Likewise, an air contacting surface of the skin evaporator may be formed of a first material with a first thermal conductivity. An insulation contacting surface of the skin evaporator may be formed of a second material with a second thermal conductivity lower than the first thermal conductivity. Therefore, heat conduction between the skin condenser and skin evaporator is further reduced. Additionally, an increase in the thermal conductivity of the outer plate of the condenser and the outer plate of the evaporator, causes an increase in the conduction of heat transfer along these plates. As such, an increase in conduction in an outer plate of a skin condenser and a skin evaporator promotes uniform temperature distribution on these surfaces.

Figure 1B:
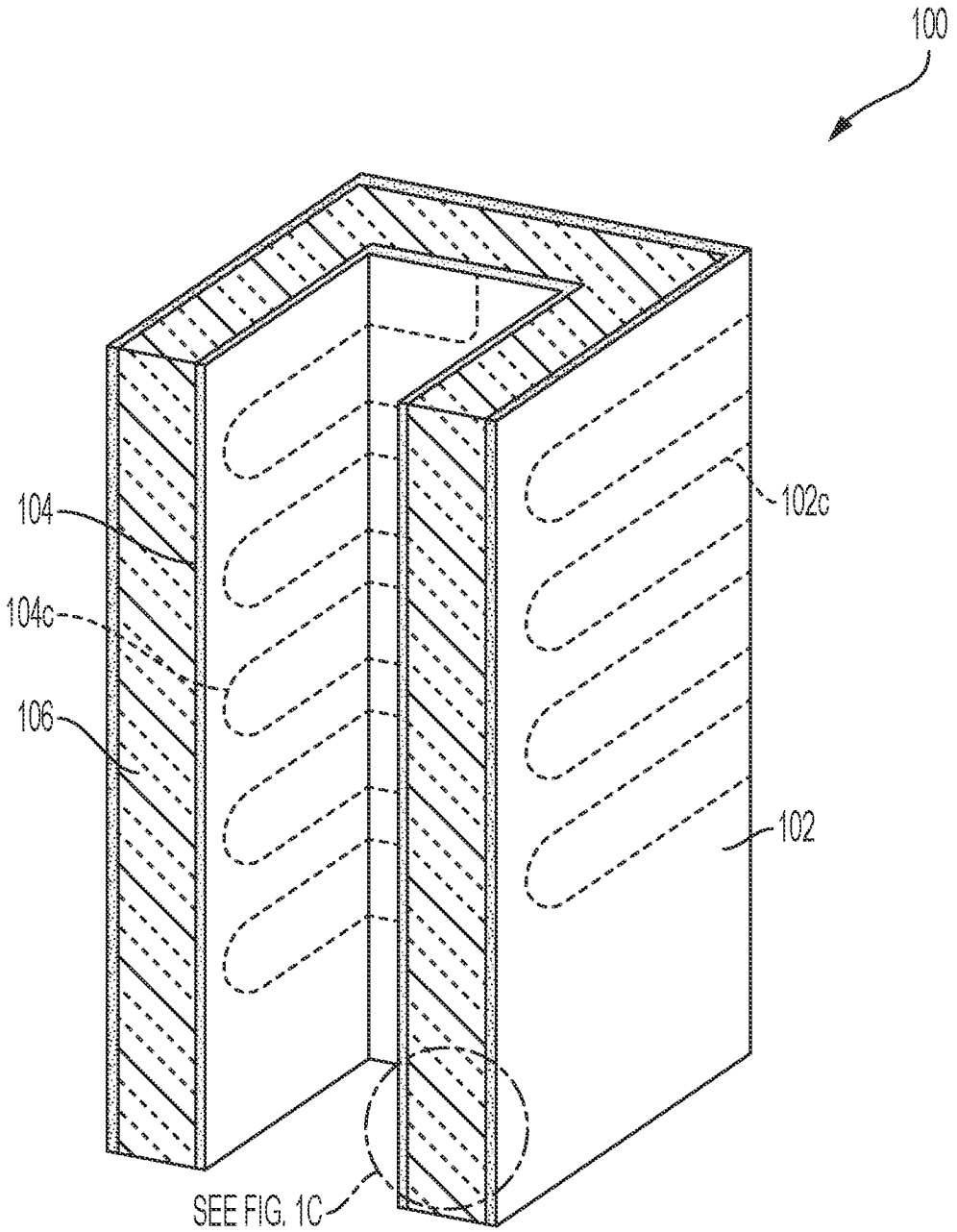
FIG. 1B shows a perspective view of a heat exchanger module having three sides.
Figure 1C:
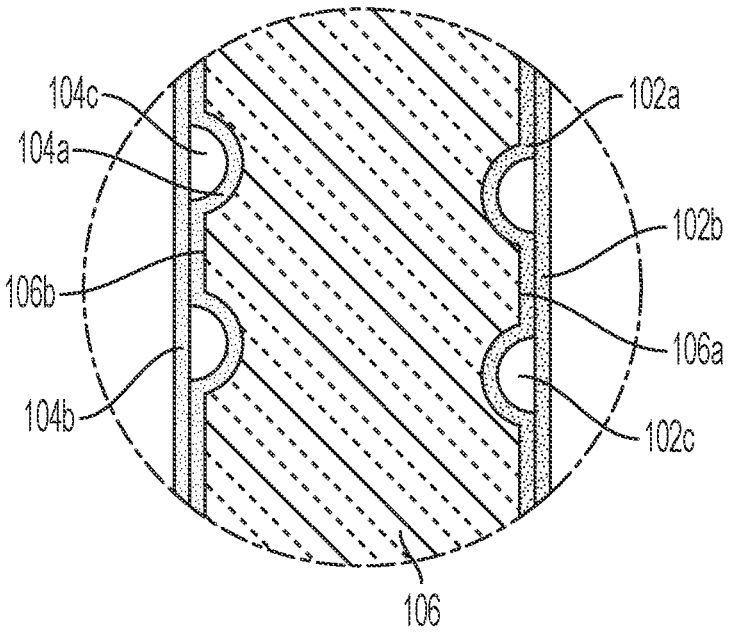
FIG. 1C shows a magnified view of a cross-sectional view of the heat exchanger module showing a skin condenser, a skin evaporator, and an insulation layer.

FIGS. 1A-C show a heat exchanger module 100. The heat exchanger module 100 has a skin condenser 102, a skin evaporator 104, and an insulation layer 106. The skin condenser 102 includes an inner condenser plate 102*a*, an outer condenser plate 102*b*, and a condenser tube channel 102*c*. The inner condenser plate 102*a* is in contact with the insulation layer 106 while the outer condenser plate 102*b* is in contact with air surrounding the heat exchanger module 100 (e.g., ambient air). In some implementations, the inner condenser plate 102*a* and the outer condenser plate 102*b* each form a flattened surface. In some implementations, the inner condenser plate 102*a* and/or the outer condenser plate 102*b* include the condenser tube channel 102*c* formed thereon. The condenser tube channel 102*c* includes contours in the flattened plate surface that form a passage having a condenser inlet 102*d* and a condenser outlet 102*e*. The condenser tube channel 102*c* forms a serpentine channel having a canalization pattern across a surface of the inner condenser plate 102*a* and/or the outer condenser plate 102*b*. The canalization pattern includes a series of bends and elongated sections between the inlet 102*d* and the outlet 102*e*. As such, a refrigeration fluid can travel through the condenser tube channel 102*c* along a surface of the skin condenser 102 to disburse heat along the surface of the skin condenser 102. The canalization pattern forms a continuous passage, wherein fluid can pass freely between the inlet 102*d* and the outlet 102*e*. In some implementations, the canalization pattern is distributed evenly about the surface of the skin condenser 102. In some implementations, a length of the condenser tube channel 102*c* is longer than for a conventional refrigeration heat exchanger. In some implementations, the canalization pattern of the condenser tube channel 102*c* is distributed across an exterior surface area of a refrigerated cabinet, thereby distributing the condenser tube channel 102*c* across a larger surface area than a conventional refrigeration heat exchanger. The distribution of the condenser tube 102*c* across the surface area of the exterior surface of a refrigerated cabinet increases the distribution of the heat removal from the condenser such that no fans are required to circulate air for heat removal. In some implementations, the inner condenser plate 102*a* and the outer condenser plate 102*b* are coupled together through a roll-bonding process forming the canalization pattern.

The skin evaporator includes an inner evaporator plate 104*a*, an outer evaporator plate 104*b*, and an evaporator tube channel 104*c*. The inner evaporator plate 104*a* is in contact with the insulation layer 106 while the outer evaporator plate 104*b* is in contact with air surrounding the heat exchanger module 100 (e.g., ambient air). In some implementations, the inner evaporator plate 104*a* and the outer evaporator plate 104*b* each form a flattened surface. In some implementations, the inner evaporator plate 104*a* and/or the outer evaporator plate include the evaporator tube channel 104*c* formed thereon. The evaporator tube channel 104*c* includes contours in the flattened plate surface that form a passage having an evaporator inlet 104*d* and an evaporator outlet 104*e*. The evaporator tube channel 104*c* forms a coiled channel having the canalization pattern across a surface of the inner evaporator plate 104*a* and/or the outer evaporator plate 104*b*. The canalization pattern includes a series of bends and elongated sections between the inlet 104*d* and the outlet 104*e*. As such, a refrigeration fluid can travel through the evaporator tube channel 104*c* along a surface of the skin evaporator 104 which generally encompasses a surface area of the skin evaporator 104 within refrigerate a volume. The canalization pattern forms a continuous passage, wherein fluid can pass freely between the inlet 104*d* and the outlet 104*e*. In some implementations, the canalization pattern is distributed evenly about the surface area of the skin evaporator 104. In some implementations, the inner evaporator plate 104*a* and the outer evaporator plate 104*b* are coupled together through a roll-bonding process forming the canalization pattern.

The insulation layer 106 has a first surface 106*a* and a second surface 106*b*. The insulation layer 106 is formed such that it provides a thermal barrier between the first surface 106*a* and the second surface 106*b*, at least partially preventing heat transfer between the first surface 106*a* and the second surface 106*b*. The insulation layer 106 can be formed from an insulation material such as an open or close cell foam such as a polyurethane foam or other thermal insulation.

In some implementations the skin condenser 102, skin evaporator 104, and insulation layer 106 are coupled together. For example, the skin condenser 102 and skin evaporator 104 may be adhered to a pre-fabricated insulation layer 106. Alternatively, the skin condenser 102 and skin evaporator 104 may be placed in a mold and the insulation layer 106 may be sprayed or poured in a void between the skin condenser 102 and skin evaporator 104 and allowed to set. The inner condenser plate 102*a* is coupled to the first surface 106*a* of the insulation layer 106, and the inner evaporator plate 104*a* is coupled to the second surface 106*b* of the insulation layer 106. The inner condenser plate 102*a* and the inner evaporator plate 104*a* are each disposed between the insulation layer 106 and the outer condenser plate 102*b* and the outer evaporator plate 104*b* respectively. In some implementations, the inner condenser plate 102*a* and the inner evaporator plate 104*a* protrude into the insulation layer 106. The contoured surface of the condenser tube channel 102*c* and the evaporator tube channel 104*c* are embedded into the insulation layer 106 such that the contoured surfaces are covered by the insulation. For example, in an implementation where the contour in the inner condenser plate 102*a* and the inner evaporator plate 104*a* each have a semispherical cross-sectional shape as shown in FIG. 1C, the insulation covers the entirety of the semispherical contours. The outer condenser layer 102*b* and the outer evaporator layer 104*b* are each flush with the first surface 106*a* and the second surface 106*b* of the insulation layer. The inner condenser plate 102*a* and the inner evaporator plate 104*a* can be coupled to the insulation layer 106 using an adhesive or any other fastening mechanism capable of coupling a plate to an insulation layer.

Figure 1D:
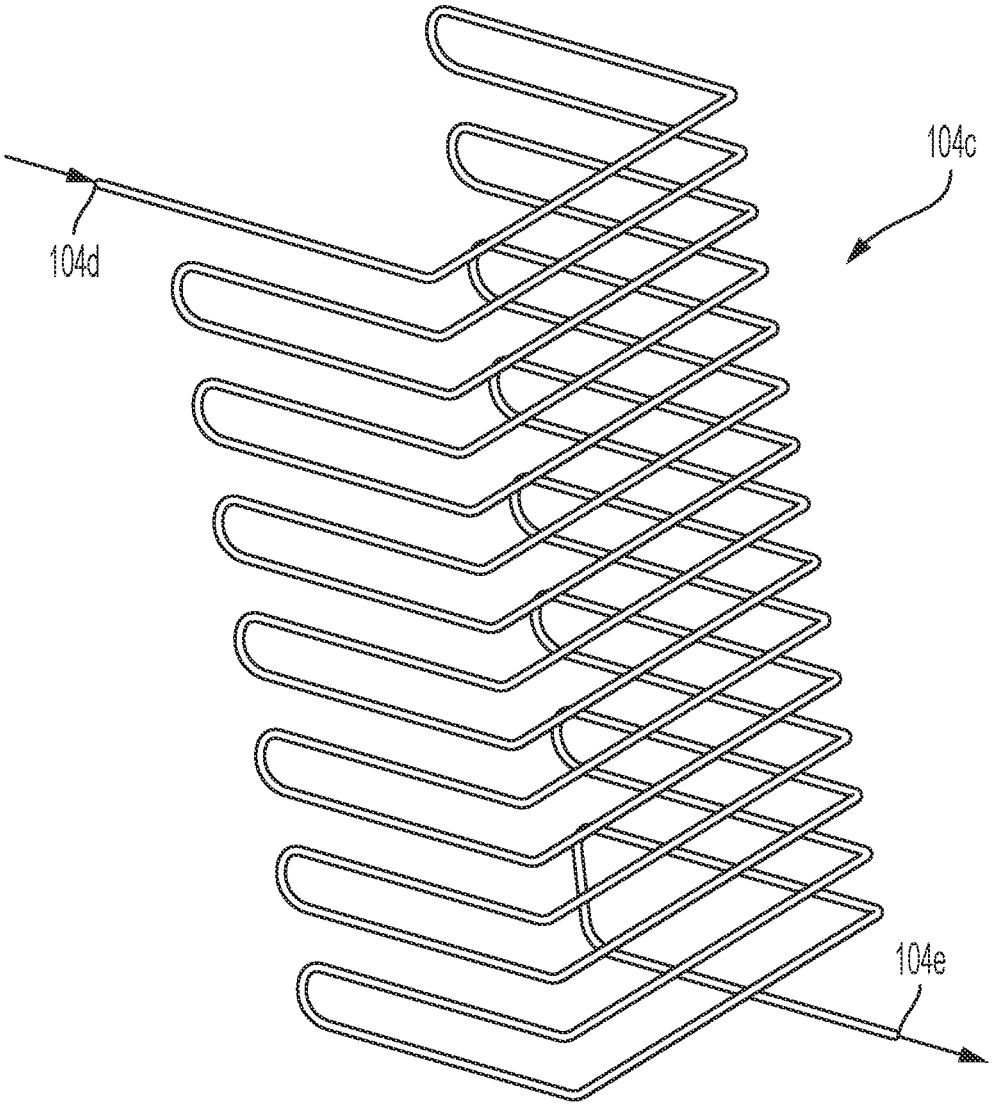
FIG. 1D shows a perspective view of an evaporator tube channel configuration.

In some implementations, the heat exchanger module 100 is a generally planar device such as the implementation shown in in FIG. 1A where the heat exchanger module forms a rectangular cuboid shape. In some implementations, the heat exchanger module 100 is a non-planar shape that includes curved or bent surfaces with corners, such as the implementation shown in FIG. 1B. In some implementations, the heat exchanger module 100 is formed to fit the shape of a refrigeration enclosure such as a refrigerated cabinet, or a portion of a refrigeration enclosure formed to enclose a refrigerated volume. In implementations where the heat exchanger module 100 has a non-planar shape, the condenser tube channel 102*c* and the evaporator tube channel 104*c* each follow the c-shaped longitudinal cross section curvature of the non-planar shape as shown in FIG. 1D.

In some implementations, the canalization pattern of the condenser tube channel 102*c* is oriented, such that oil, which can be mixed with refrigerant, can travel vertically through the canalization pattern. As such, gravity assists the flow of the mixture of oil and refrigerant through the canalization pattern. When in this orientation, the canalization pattern can reduce the oil retention inside the pipes, which, contributes to the return of oil to the compressor. In the evaporator shown in FIG. 1D, the refrigerant enters at a top and leaves it the bottom of the canalization pattern of the condenser tube channel 102*c*. This canalization arrangement will facilitate the oil return to a compressor shell. This configuration also reduces the time required to equalize pressure during the period where the compressor is turned off, as it promotes fluid flow through the system. In some implementations, a suction line is connected to the evaporator outlet 104*e* in one end and to the compressor at the other end. As such, no oil trap is required in the system. The refrigerant flows directly to the compressor shell. In implementations, where the heat exchanger module 100 is integrated with a refrigerated cabinet, the evaporator inlet is disposed inside the refrigerated cabinet, and the condenser outlet is disposed outside the refrigerated cabinet, such that the evaporator outlet is separated from air inside the refrigerated cabinet.

Figure 2A:
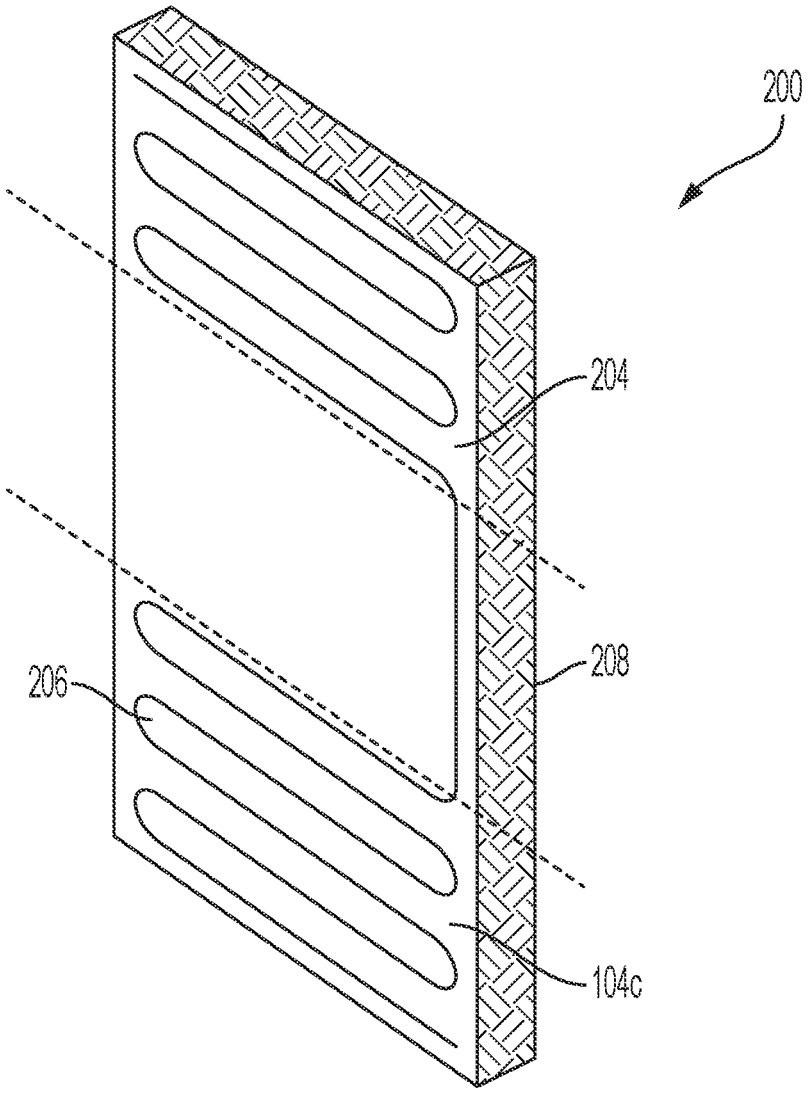
FIG. 2A shows a perspective view of a heat exchanger module having an evaporator tube channel arrangement concentrated toward areas of an upper and a lower portion of the heat exchanger module.
Figure 2B:
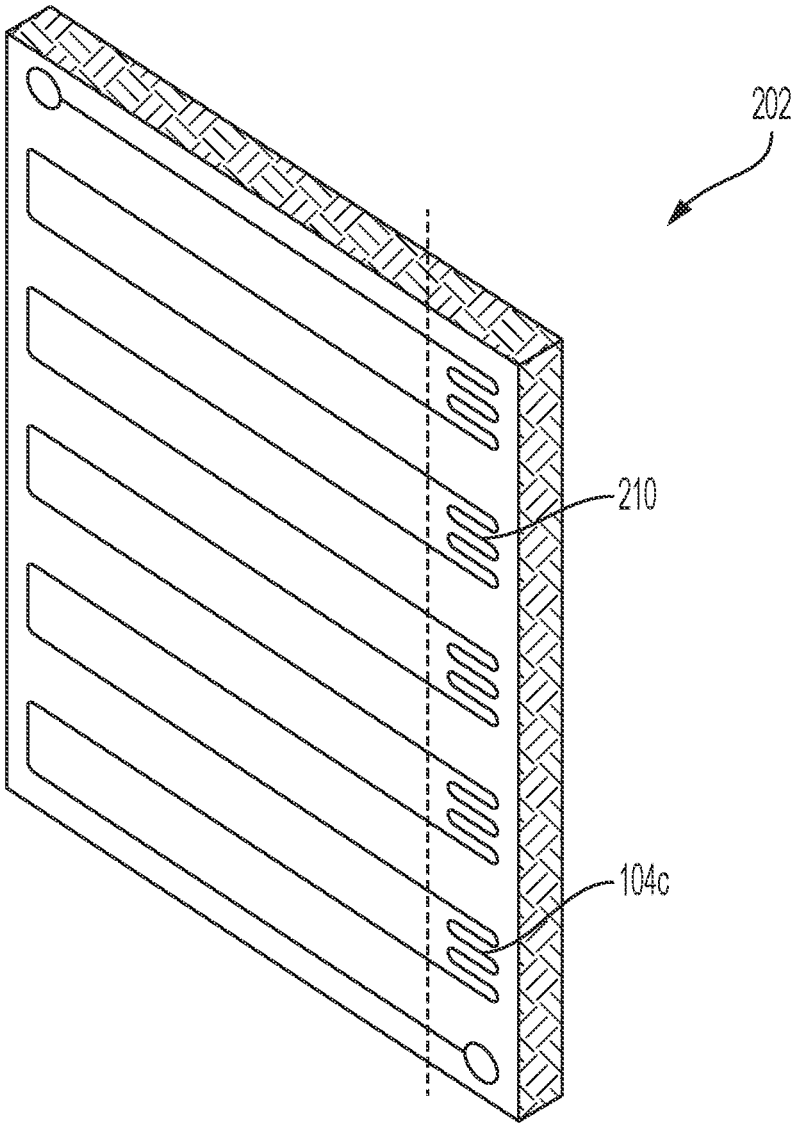
FIG. 2B shows a perspective view of a heat exchanger module having an evaporator tube channel arrangement concentrated toward a side of the heat exchanger module.

FIGS. 2A-B show implementations of the heat exchanger module 200, 202 having the evaporator tube channel 104*c* formed in a non-uniformly distributed canalization pattern. The non-uniformly distributed canalization pattern of the evaporator tube channel 104*c* shown in FIG. 2A is such that the canalization pattern includes more contoured sections or coils at an upper portion 204 and a lower portion 206 of the heat exchanger module 100 than in a middle portion 208 of the heat exchanger module 100. In some implementations, refrigerant will follow a canalization pattern where additional contours are disposed in the upper portion 204 of the heat exchanger module 100. The refrigerant is circulated to a lower portion 206 where additional contours are disposed in the lower portion 206 of the heat exchanger module 100. The additional contours allow the refrigerant to circulate along additional surface area in a desired portion of the heat exchanger 200 to provide additional refrigerating effects at that location, by extracting heat from an adjacent environment. This configuration also keeps refrigerant from pooling at choke points in the canalization pattern. The vertical section in the middle portion 208 of the heat exchanger 200 promotes consistent fluid flow throughout the system by allowing the refrigerant to maintain consistent directional flow which is assisted by gravity. In some implementations, a greater number of contours are disposed in the upper section 204 than the lower section 206 of the skin evaporator 104. This configuration, containing additional contours in a specific portion of the skin evaporator can be useful where a refrigerated cabinet requires a colder temperature at specific section, such as a freezer or produce section. In other implementations, such as the implementation shown in FIG. 2B, the evaporator tube channel 104*c* has additional contours along the length of the heat exchanger module, toward a side 210 of the heat exchanger module 100. The refrigerant will provide additional refrigeration effects to the side 210 having the additional contours. In some implementations, the additional contours are situated at an outer section of the heat exchanger module 100 toward an inlet to a refrigerated cabinet such as a door, where warm air can enter the refrigerated cabinet. This increased refrigeration effect can help maintain a cool inner air inside the refrigerated cabinet at locations most affected by ingress warm air. Additionally, providing increased refrigeration adjacent to the door ensures that products more likely to be selected by a consumer are maintained at a desired temperature.

Figure 3A:
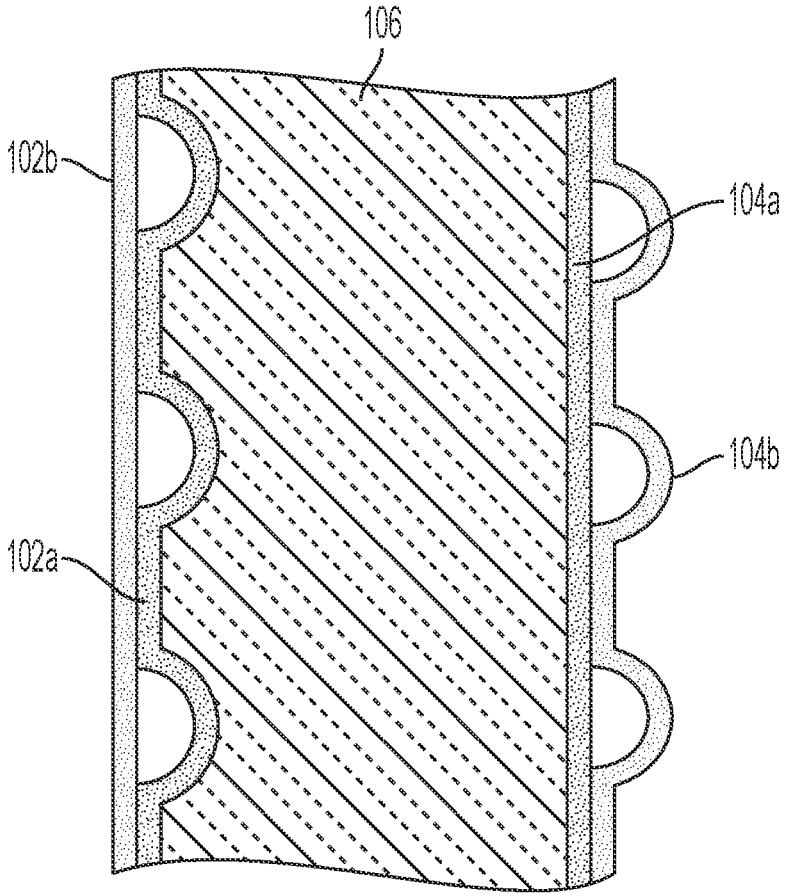
FIG. 3A shows an implementation of a heat exchanger module with the skin condenser, skin evaporator, and insulation where contours in the skin condenser protrude into the insulation and contours in the skin evaporator protrude into the insulation protrude away from the insulation.
Figure 3B:
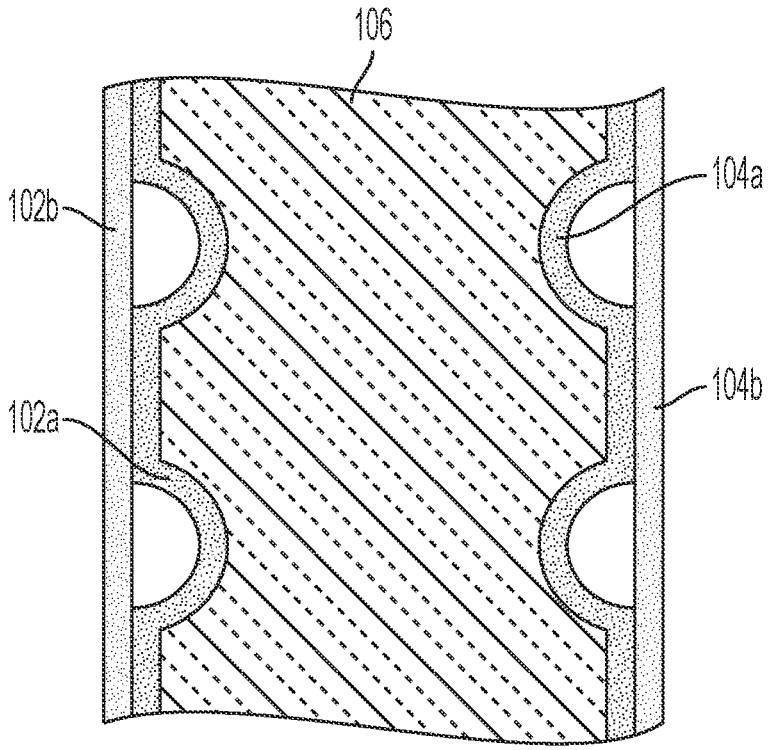
FIG. 3B shows another implementation of a heat exchanger module with the skin condenser, skin evaporator, and insulation where contours in the skin condenser and the skin evaporator protrude into the insulation.

FIGS. 3A-B show implementations where the inner condenser plate 102*a* is formed from a different material than the outer condenser plate 102*b* and/or the inner evaporator plate 104*a* is formed from a different material than the outer evaporator plate 104*b*. In some implementations, the inner condenser plate 102*a* is formed from a material having a lower thermal conductivity than the outer condenser plate 102*b*. Accordingly, heat will travel from refrigeration fluid flowing in the condenser tube channel 102*c* through the outer condenser plate 102*b* to an ambient environment more readily than through the inner condenser plate 102*a* to the insulation layer 106. Accordingly, the different materials of the inner and outer condenser plates 102*a*, 102*b* reduce an amount of heat that is able to transfer through the insulation layer 106 to the inner evaporator plate 104*a*, thereby improving the efficiency of the system.

Similarly, the inner evaporator plate 104*a* is formed from a material having a lower thermal conductivity than the outer evaporator plate 104*b*. The use of a material having higher thermal conductivity away from the insulation layer 106 promotes a more uniform temperature distribution at the outer evaporator plate, therefore, improving the heat transfer from a refrigerated environment into the evaporator tube channel 104*c*. The use of a material having higher thermal conductivity away from the insulation layer 106 also improves the heat transfer from the condenser tube channel 102*c* to an outside environment.

In some implementations, the skin condenser 102 has a contoured surface on the inner condenser plate 102*a* which protrudes into insulation layer 106 such that the outer condenser plate 102*b* provides a flat exterior on a refrigerated cabinet. Having the flat exterior reduces accumulation of dust or debris on the skin condenser 102, which would lower the heat transfer efficiency with the ambient environment. In some implementations, the outer evaporator plate 104*b* has a contoured surface of the skin evaporator 104 disposed in the refrigerated cabinet to increase the surface area of the skin evaporator 104 in communication with the refrigerated air in the refrigerated cabinet. The greater surface area removes more heat from the air within the refrigerated cabinet than would be removed with a flat outer evaporator plate 104*b*. Additionally, the inner evaporator plate 104*a* has a flat inner surface which reduces the surface area in contact with the insulation layer 106. As such, less heat is added to the refrigeration fluid through the insulation layer 106 than with a contoured inner evaporator plate 104*a*.

In some implementations, a thickness of the inner condenser plate 102*a* is greater than the thickness of the outer condenser plate 102*b*, to provide lower heat transfer than through the inner condenser plate 102*a* while using uniform materials. That is, the inner and outer condenser plates 102*a*, 102*b* are made of the same material, but have different thicknesses. In some implementations, the thickness of the inner evaporator plate 104*a* is greater than the thickness of the outer evaporator plate 104*b*, to provide lower heat transfer through the inner evaporator plate 104*a* while using uniform materials. That is, the inner and outer evaporator plates 104*a*, 104*b* are made of the same material, but have different thicknesses. In some implementations the thickness of the inner condenser plate 102*a* and the inner evaporator plate 104*a* are each increased independent of the thickness of the outer condenser plate 102*b* and the outer evaporator plate 104*c*, to lower the amount of heat transfer through the insulation layer 106 in the heat exchanger module 100.

In some implementations, the thickness of the skin condenser plates 102*a*, 102*b* and the skin evaporator plates 104*a*, 104*b* each range from 2 mm to 5 mm although any thickness appropriate for use in a skin condenser or evaporator can be used. In some implementations, the thickness of the insulation layer is 50 mm although any thickness appropriate for an insulation layer in a heat exchanger can be used. Each of these thickness and material configurations are formed to bias heat transfer from the refrigerated cabinet and limit heat transfer into the refrigerated cabinet. Each of the condenser and evaporator plates can be formed from polyurethane, polyethylene terephthalate, vacuum insulation paneling (VIP), a combination of multiple polymers, or any other material having a thermal conductivity similar to the materials described above. In some implementations, the thermal conductivity of the material is less than 177, 100, 10, 1, 0.26, 0.02, or 0.004 W/m·K. In some implementations, where VIP is used, VIP can have a core surrounded by gas-tight outer layers. The core is evacuated of air, such that heat transfer through the insulation is limited through lack of a heat transfer medium.

The various dimension and materials used in various implementations of the heat exchanger module 100 directly affect the heat transfer characteristics of the module. An analytical implementation can be conducted to illustrate the heat, leakage characteristics of the double skin heat exchanger module 100. In this example implementation, the outer condenser plate 102*b* and the outer evaporator plate 104*b* are made of Aluminum, which has a high thermal conductivity. The inner condenser plate 102*a* and the inner evaporator plate 104*a* are each formed from a material with a lower thermal conductivity than the Aluminum, such as polyethylene terephthalate. It can be assumed that the inner condenser plate 102*a* and the inner evaporator plate 104*a* will have the same surface temperature of the outer condenser plate 102*a* and the outer evaporator plate 104*a*. The lower thermal conductivity material will have a thermal conductivity 'k_i' and a thickness 't'. In this analysis 't' will vary from 2 to 5 mm, and 'k_i' are given in Table 1.

TABLE 1

| Double Skin Module | | |
|---|---|---|
| K_PU (W/m · K) | | 0.02 |
| L_PU (m) | | 0.05 |
| T_plate, c (° C.) | | −7 |
| T_plate, e (° C.) | | 38.5 |
| K_i(W/m · K) | Aluminum | 177 |
| Internal skin plate thermal conductivity | PET | 0.26 |
| | Polyurethane | 0.02 |
| | VIP | 0.004 |
| **Cabinet Physical Dimensions (internal)** | | |
| Height (m) | | 1.495 |
| Width (m) | | 0.555 |
| Length (m) | | 0.67 |
| $A_{lateral}$ ($m^2$) | | 1.00165 |

Figure 5:
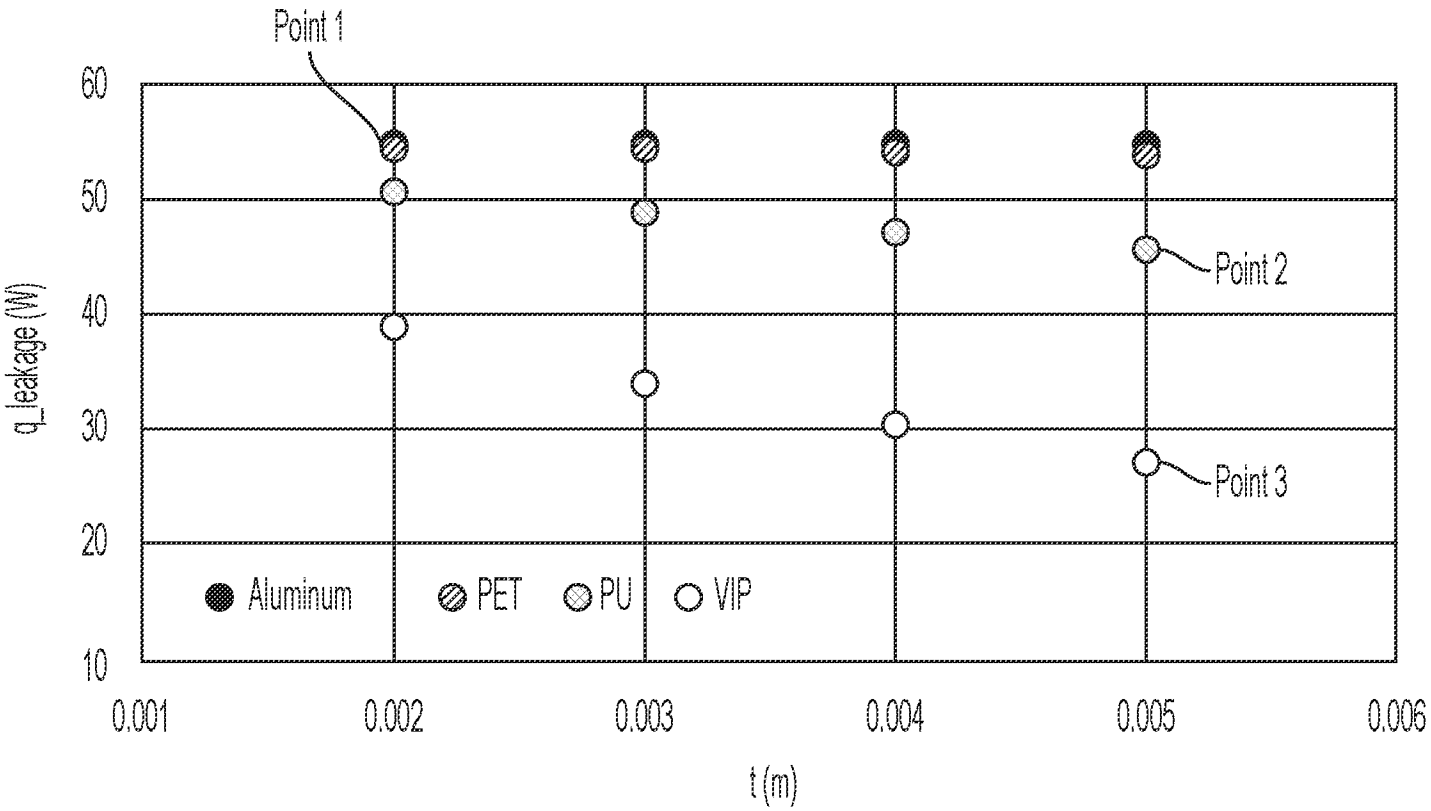
FIG. 5 shows a heat leakage plot for certain implementations of the refrigeration system utilizing certain materials and dimensions.

The effects of the lower thermal conductivity material with Thermal Conductivity (k_i) and Thickness (t) on the double skin heat exchanger module 100 internal Heat Leakage (q_leakage) are shown in the plot of FIG. 5. In some implementations, the lower thermal conductivity material has a thermal conductivity similar to or lower than the thermal conductivity of Polyurethane (PU). In such implementations, the module internal heat leakage can be significantly reduced, compared to the use of aluminum material. The plate thickness also plays an important role for the q_leakage reduction. The effect of q_leakage is more evident at lower thermal conductivities. As such, lower thermal conductivity material, and high material thickness, can be utilized in combination to minimize q_leakage. The example above shows that increasing the plate thickness from 2 mm to 5 mm, and changing the plate material from Aluminum to PU, can reduce heat leakage by 16% (moving from point 1 to point 2 in the plot shown in FIG. 5). With lower thermal conductivities, such as that of VIP, the reduction of heat q_leakage can reach 50% (moving from point 1 to point 3 in the plot shown in FIG. 5).

Figure 4A:
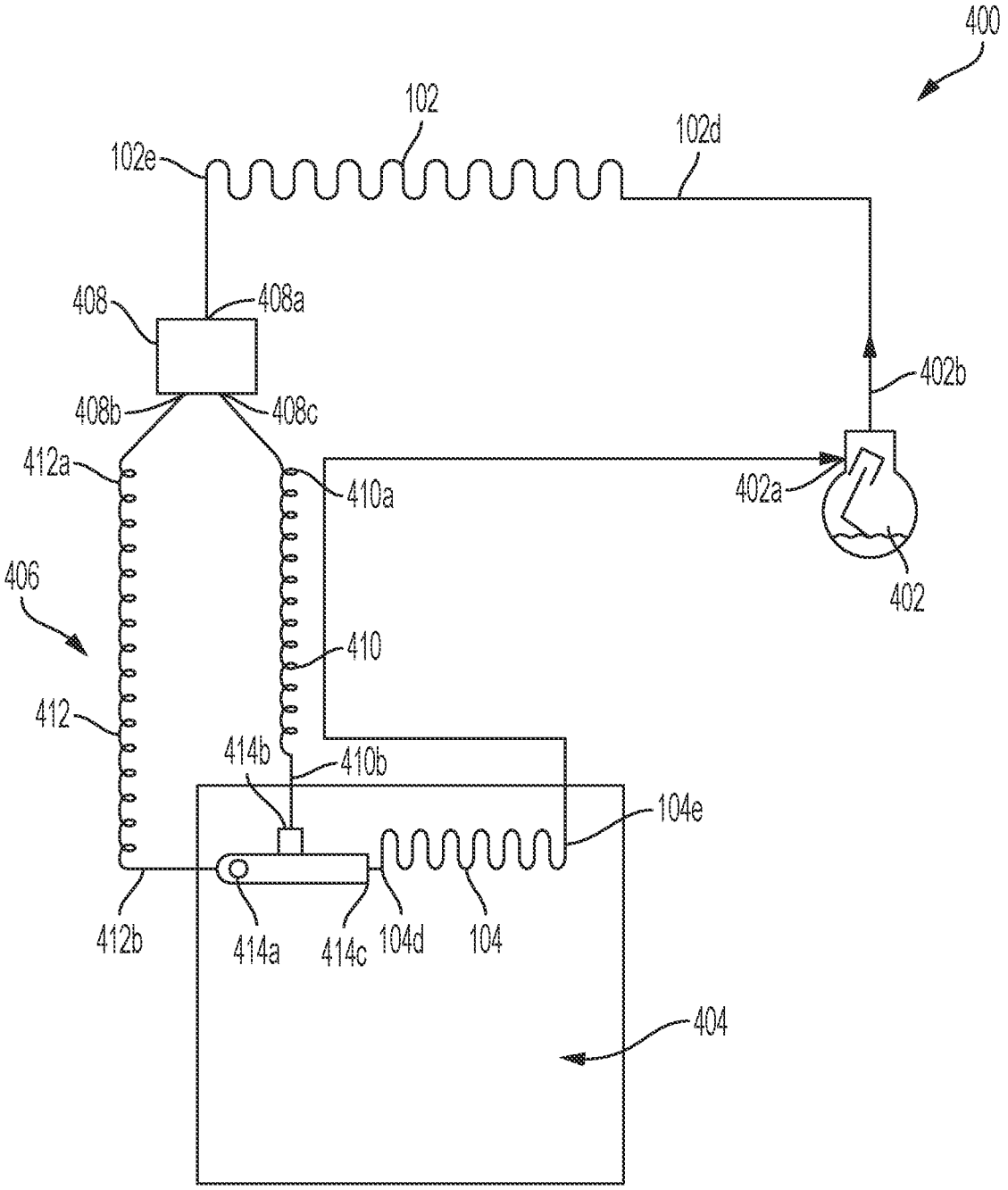
FIG. 4A shows a system diagram of a refrigeration system for use with a heat exchanger module.
Figure 4B:
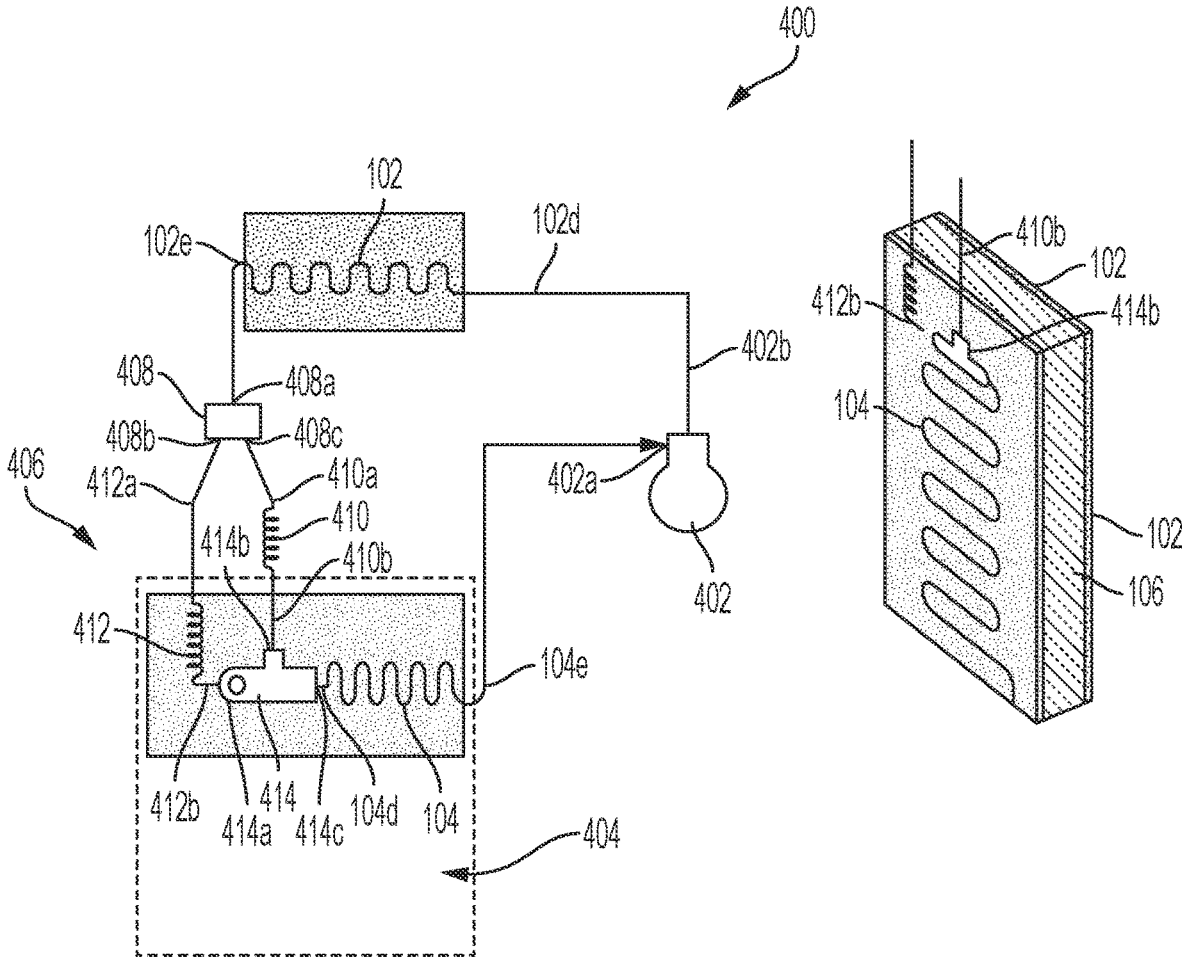
FIG. 4B shows a system diagram of a refrigeration system, for use with a heat exchanger module, and a magnified perspective view of an implementation of the heat exchanger module having an integrated t-joint, and capillary tubes.

FIGS. 4A-4B show a refrigeration system 400. The system 400 includes the heat exchanger module 100 as described above in FIGS. 1A-3B. The system also includes a compressor 402, and a refrigerated cabinet 404. In some implementations, the system also includes a defrost loop 406. The compressor 402 has an inlet 402*a* and an outlet 402*b*. The compressor 402 is a device capable of compressing a gas such as refrigeration fluid. The condenser 102, as described above, is connected in series with the compressor 402. The compressor 402 provides compressed refrigeration fluid to the condenser 102 where heat is rejected to the ambient environment through natural convection, and without any forced air flow.

The defrost loop 406 includes a two-way valve 408, a circulation capillary 410 having an inlet 410*a* and an outlet 410*b* and a defrosting capillary 412 having an inlet 412*a* and an outlet 412*b*, and a t-joint 414. The circulation capillary 410 has a smaller internal diameter than the defrosting capillary 412, such that less heat is removed from a surrounding environment when refrigeration fluid travels through the defrosting capillary 412 than through the circulation capillary 410. The t-joint 414 has a check valve 414*a*, a main inlet 414*b* and an outlet 414*c*. The check valve 414*a* is formed to promote one-way fluid flow therethrough. As such, the check valve prevents fluid from the evaporator tube channel and the circulation capillary from entering the defrosting capillary 412, during a stand still period, where the compressor 402 is turned off. In some implementations, the two-way valve 408 has one inlet 408*a* and two outlets 408*b*-*c*.

The evaporator 104, as described above, is connected in series with the defrosting loop 406. Saturated vapor refrigerant in the evaporator 104 absorbs heat from the air inside refrigerated cabinet 404 and flows out of the evaporator outlet 104*e*. This fluid flow transports heat out of the refrigerated cabinet, thus creating a refrigerating effect in the cabinet 404. As discussed above, in some implementations, the surface area of the evaporator 104 is sufficient to provide a refrigerated cabinet 404 with sufficient heat removal to cool the air inside it without any forced air flow.

The inlet 410*a* of the circulation capillary 410 and the inlet 412*a* of the defrosting capillary 412 are each coupled to an outlet 408*b-c* of the two-way valve 408. In some implementations, the outlet 412*b* of the defrosting capillary 412 is coupled to the check valve 414*a* of the t-joint 414 and the outlet 410*b* of the circulation capillary 410 is fluidically coupled to the main inlet 414*b* of the t-joint 414. In some implementations, the skin condenser 102, skin evaporator 104, and compressor 402 are connected in series. The compressor outlet 402*b* is fluidically coupled to the condenser inlet 102*d*. In some implementations, the system 400 also includes a suction line between the evaporator outlet and the compressor inlet (not shown), to promote even fluid flow throughout the system. In some implementations, the suction line will be put in thermal contact with the main capillary tube 410 and/or the defrosting capillary tube 412 in order to form a liquid-line-suction-line heat exchanger, thereby increasing the overall efficiency of the refrigeration system 400. The condenser outlet 102*e* is fluidically coupled to the evaporator inlet 104*d*, and the outlet 104*e* of the evaporator 104 is coupled to the inlet 402*a* compressor 402.

In other implementations, the defrost loop 406 is disposed in series in the heat exchanger modular system 400, such that the inlet 408*a* of the two-way valve 408 is coupled to the outlet 102*e* of the condenser 102, and the outlet of the t-joint 414 is coupled to the inlet 104*d* of the evaporator 104. An outer surface of the evaporator 104 is disposed inside the refrigerated cabinet 404 and is in thermal communication with air inside the refrigerated cabinet.

The heat exchanger modular system 400 can operate in a defrost mode and a cooling mode. In the defrosting mode, the heat exchanger module 400 forms a fluid loop with the defrosting capillary 412. The two-way valve 408 directs refrigeration fluid through the defrosting capillary 412 and restricts fluid from circulating though the circulation capillary 410 when in the defrost mode. In the defrost mode, refrigerant travels through the defrosting 412 capillary, which has a greater diameter than that of the circulation capillary 410. As such, the refrigerant circulates at a high temperature as it exits the condenser, due to increased fluid expansion. The higher temperature refrigerant will flow through the evaporator tube channel 104*c*. This facilitates defrosting in the evaporator 104. If frost or ice is formed on the evaporator 104, such as on the inner evaporator plate 104*a*, the high temperature fluid will defrost such a layer of frost or ice.

In the cooling mode, the heat exchanger module 400 forms a fluid loop with the circulation capillary 410. The two-way valve 408 directs refrigeration fluid through the circulation capillary 410 and restricts fluid from circulating though the defrosting capillary 412 when in cooling mode.

In the cooling mode, refrigerant is directed through the circulation capillary 410 which maintains a diameter that facilitates the removal of heat in a surrounding environment such as the air inside of a refrigerated cabinet, due to the evaporation of a fluid such as refrigerant, within the evaporator.

The heat exchanger system 400 can be operated without any fans, as discussed above. The system 400 is configured to remove heat from the refrigerated cabinet through natural convection. As such, the system 400, when in the defrost mode is configured to defrost the refrigerated cabinet without any forced air flow.

Examples

In some examples, the inner condenser plate, outer condenser plate, inner evaporator plate, and outer evaporator plate, are formed from a material selected from the group consisting of polyurethane, polyethylene terephthalate, vacuum insulation paneling, and a combination of multiple polymers.

In some examples, the diameter of the defrosting capillary is greater than the diameter of the circulation capillary.

In some examples, a t-joint having two inlets, wherein the inlets are coupled to the circulation capillary and the defrosting capillary. The check valve is disposed at the inlet coupled to the defrosting capillary.

In some examples, the circulation capillary and the defrosting capillary are at least partially disposed between the inner evaporator plate and the outer evaporator plate.

In some examples, the t-joint is at least partially disposed between the inner evaporator plate and the outer evaporator plate.

While several implementations have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A heat exchanger module comprising:

a skin condenser comprising:

an inner condenser plate comprising vacuum insulative paneling, an outer condenser plate comprising aluminum, the outer condenser plate coupled to the inner condenser plate, wherein the inner condenser plate has a lower thermal conductivity than the outer condenser plate, and a condenser tube channel formed on one of the inner condenser plate or the outer condenser plate, a skin evaporator comprising:

an inner evaporator plate, an outer evaporator plate coupled to the inner evaporator plate, wherein the inner evaporator plate has a lower thermal conductivity than the outer evaporator plate, and an evaporator tube channel formed on one of the inner evaporator plate or the outer evaporator plate; and an insulation layer extending between the inner condenser plate and the inner evaporator plate, wherein the heat exchanger module comprises a non-planar shape that includes at least one curved surface with a corner, wherein the condenser tube channel and the evaporator tube channel each follow the curvature of the non-planar shape.

2. The module of claim 1, wherein the skin evaporator is configured to form at least a portion of a refrigeration enclosure, and wherein the skin evaporator is formed to remove heat from the refrigeration enclosure through natural convection.

3. The module of claim 1, wherein an internal surface of the inner condenser plate and an internal surface of the outer condenser plate are at least partially coupled together, and wherein an internal surface of the inner evaporator plate and an internal surface of the outer evaporator plate are at least partially coupled together.

4. The module of claim 1, wherein the inner condenser plate and the outer condenser plate are coupled together and the inner evaporator plate and the outer evaporator plate are coupled together by one or more of roll-bonding, adhesion, welding, or brazing.

5. The module of claim 1, wherein the evaporator tube channel has an inlet and an outlet and forms a canalization pattern, wherein the canalization pattern comprises a series of bends and elongated sections between the inlet and the outlet, wherein the inlet is disposed above the outlet to facilitate gravity assisted flow of fluid within the evaporator tube channel.

6. The module of claim 5, wherein the canalization pattern is evenly distributed between the inlet and the outlet of the evaporator tube channel.

7. The module of claim 5, wherein the canalization pattern is non-uniformly distributed between the inlet and the outlet of the evaporator tube channel.

8. The module of claim 5, wherein the skin evaporator further comprises an upper section, a lower section, and a vertical section disposed in between the upper section and the lower section, the vertical section configured to facilitate gravity assisted flow of fluid within the evaporator tube channel, and wherein a greater portion of the evaporator tube channel is disposed in the lower section than the upper section.

9. The module of claim 5, wherein the skin evaporator further comprises an inner section and an outer section, wherein, a greater portion of a surface area of a capillary is disposed in the outer section than the inner section.

10. The module of claim 5, further comprising a suction line extending between the outlet of the evaporator tube channel and an inlet of a compressor.

11. The module of claim 10, wherein the suction line is in thermal contact with a capillary tube.

12. The module of claim 5, wherein the canalization pattern comprises a denser portion of the series of bends and elongated sections adjacent to one side of the heat exchanger module, wherein the side of the heat exchanger module having the denser portion is configured as a door side.

13. The module of claim 1, wherein the skin condenser, the skin evaporator, and the insulation layer are formed to conform to the shape of a refrigeration enclosure.

14. The module of claim 1, wherein a thickness of the inner condenser plate is greater than a thickness of the outer condenser plate, and wherein a thickness of the inner evaporator plate is greater than the thickness of the outer evaporator plate.

15. A heat exchanger modular system comprising:

a heat exchanger module comprising:

a skin condenser comprising:

an inner condenser plate comprising vacuum insulative paneling, an outer condenser plate comprising aluminum, the outer condenser plate coupled to the inner condenser plate, wherein the inner condenser plate has a lower thermal conductivity than the outer condenser plate, and a condenser tube channel on one of the inner condenser plate or the outer condenser plate, a skin evaporator comprising:

an inner evaporator plate, an outer evaporator plate coupled to the inner evaporator plate, wherein the inner evaporator plate has a lower thermal conductivity than the outer evaporator plate, and an evaporator tube channel on one of the inner evaporator plate or the outer evaporator plate; and an insulation layer extending between the inner condenser plate and the inner evaporator plate;

a compressor disposed between and in fluidic communication with the condenser and the evaporator; and a refrigerated cabinet having an enclosure surface, wherein the evaporator tube channel is in thermal communication with the refrigerated cabinet, wherein the heat exchanger module comprises a non-planar shape conforming to the refrigerated cabinet that includes at least one curved surface with a corner, wherein the condenser tube channel and the evaporator tube channel each follow the curvature of the non-planar shape.

16. The modular system of claim 15, wherein the refrigerated cabinet encloses a refrigeration volume, wherein air in the refrigeration volume exchanges heat with the skin evaporator by natural convection.

17. The modular system of claim 15, further comprising a defrost loop disposed between and in fluidic communication with the condenser tube channel and the evaporator tube channel.

18. The modular system of claim 17, wherein the defrost loop comprises:

a 2-way valve coupled to the condenser tube channel;

a check valve coupled to the evaporator tube channel; and a circulation capillary coupled to and extending between the 2-way valve and the check valve, and a defrosting capillary coupled to and extending between the 2-way valve and the check valve;

wherein the defrost loop is configurable between a circulation configuration and a defrosting configuration, wherein the 2-way valve is formed to channel fluid through the circulation capillary when in the circulation configuration, and wherein the 2-way valve is formed to channel fluid thorough the defrosting capillary, when in the defrosting configuration, wherein the check valve is formed to prevent fluid from the evaporator tube channel and the circulation capillary from entering the defrosting capillary.

19. A heat exchanger modular system comprising:

a heat exchanger module comprising:

a skin condenser comprising:

an inner condenser plate, an outer condenser plate coupled to the inner condenser plate, and a condenser tube channel on one of the inner condenser plate or the outer condenser plate, a skin evaporator comprising:

an inner evaporator plate, an outer evaporator plate coupled to the inner evaporator plate, and an evaporator tube channel on one of the inner evaporator plate or the outer evaporator plate; and an insulation layer extending between the inner condenser plate and the inner evaporator plate;

a compressor disposed between and in fluidic communication with the condenser and the evaporator;

a refrigerated cabinet having an enclosure surface, wherein the evaporator tube channel is in thermal communication with the refrigerated cabinet; and a defrost loop disposed between and in fluidic communication with the condenser tube channel and the evaporator tube channel, the defrost loop comprising:

a 2-way valve coupled to the condenser tube channel;

a check valve coupled to the evaporator tube channel;

a circulation capillary coupled to and extending between the 2-way valve and the check valve; and a defrosting capillary coupled to and extending between the 2-way valve and the check valve, wherein the defrost loop is configurable between a circulation configuration and a defrosting configuration, wherein the 2-way valve is formed to channel fluid through the circulation capillary when in the circulation configuration, wherein the 2-way valve is formed to channel fluid thorough the defrosting capillary, when in the defrosting configuration, and wherein the check valve is formed to prevent fluid from the evaporator tube channel and the circulation capillary from entering the defrosting capillary.

* * * * *